US008001796B2

(12) United States Patent
Kim et al.

(10) Patent No.: US 8,001,796 B2
(45) Date of Patent: Aug. 23, 2011

(54) DISPENSER RELATED TECHNOLOGY

(75) Inventors: Seong Jae Kim, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 645 days.

(21) Appl. No.: 12/166,780

(22) Filed: Jul. 2, 2008

(65) Prior Publication Data

US 2009/0013699 A1 Jan. 15, 2009

(30) Foreign Application Priority Data

Jul. 6, 2007 (KR) ..... 10-2007-0068119

(51) Int. Cl.
*F25C 1/00* (2006.01)

(52) U.S. Cl. ..... 62/66; 62/390

(58) Field of Classification Search ..... 62/66, 161, 62/389, 390, 440, 126; 222/52, 146.6; 312/121, 312/124, 127, 405
See application file for complete search history.

(56) References Cited

U.S. PATENT DOCUMENTS

| | | | | |
|---|---|---|---|---|
| 6,182,453 | B1 * | 2/2001 | Forsberg | 62/125 |
| 6,497,343 | B1 | 12/2002 | Teetsel | |
| 7,269,968 | B2 * | 9/2007 | Harder et al. | 62/389 |
| 7,337,594 | B2 * | 3/2008 | Sus et al. | 53/495 |
| 7,568,359 | B2 * | 8/2009 | Wetekamp et al. | 62/135 |
| 7,617,698 | B2 * | 11/2009 | Bowen et al. | 62/264 |
| 2002/0148858 | A1 * | 10/2002 | Bertone | 222/129.4 |
| 2004/0129725 | A1 * | 7/2004 | Bertone | 222/129.4 |
| 2006/0201193 | A1 * | 9/2006 | Bowen et al. | 62/344 |
| 2006/0201194 | A1 | 9/2006 | Bowen et al. | |
| 2006/0266061 | A1 * | 11/2006 | Wetekamp et al. | 62/228.1 |
| 2007/0131711 | A1 * | 6/2007 | Minard et al. | 222/105 |
| 2007/0228152 | A1 * | 10/2007 | Washington et al. | 235/379 |

FOREIGN PATENT DOCUMENTS

| | | |
|---|---|---|
| KR | 10-2004-0013820 | 2/2004 |
| KR | 10-2005-0028360 | 3/2005 |
| KR | 10-2005-0033296 | 4/2005 |
| KR | 10-2007-0066297 | 6/2007 |
| WO | 2007/063039 | 6/2007 |

OTHER PUBLICATIONS

International Search Report & Written Opinion issued in International Application No. PCT/KR2008/003879, mailed Jul. 1, 2009, 9 pages.

* cited by examiner

*Primary Examiner* — Mohammad Ali
(74) *Attorney, Agent, or Firm* — Fish & Richardson P.C.

(57) ABSTRACT

A food storing apparatus dispenses a content stored in the apparatus. The food storing apparatus includes a button tray that functions as a switch to control dispensing of different contents in accordance with different moved positions of the button tray, but also functions as a tray to receive a residual content discharged after dispensing the content.

25 Claims, 9 Drawing Sheets

【Fig. 1】
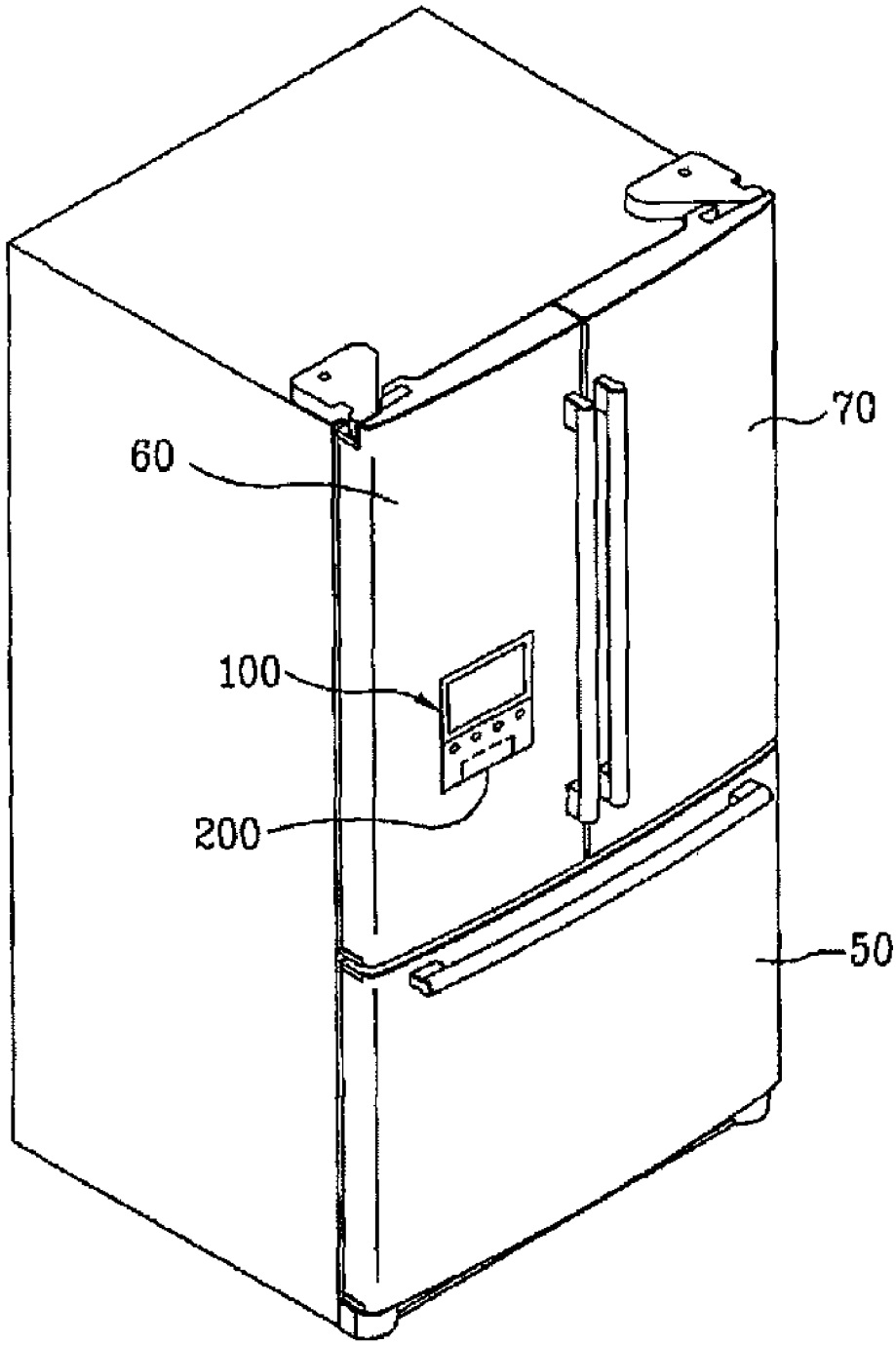

【Fig. 2】
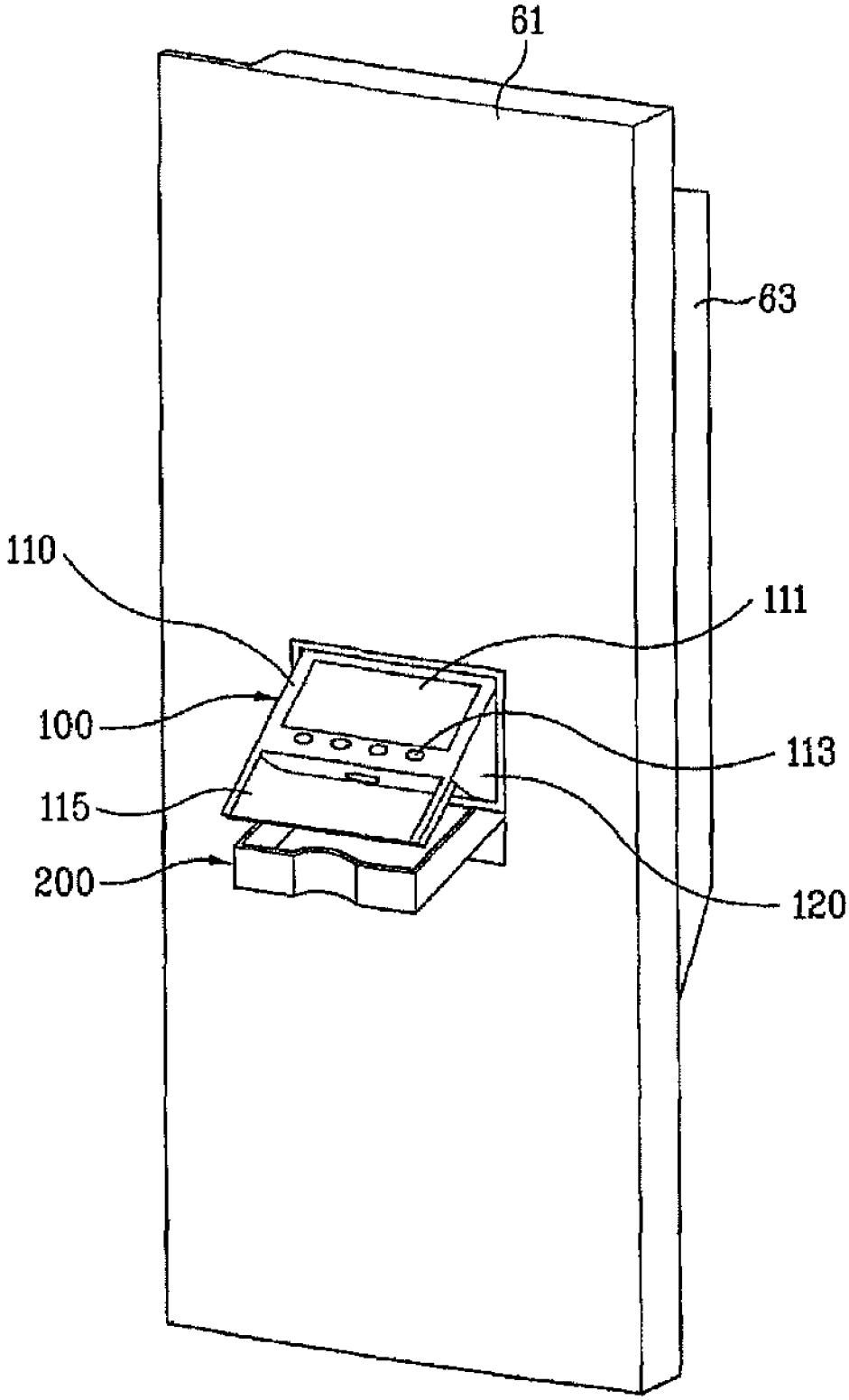

【Fig. 3a】
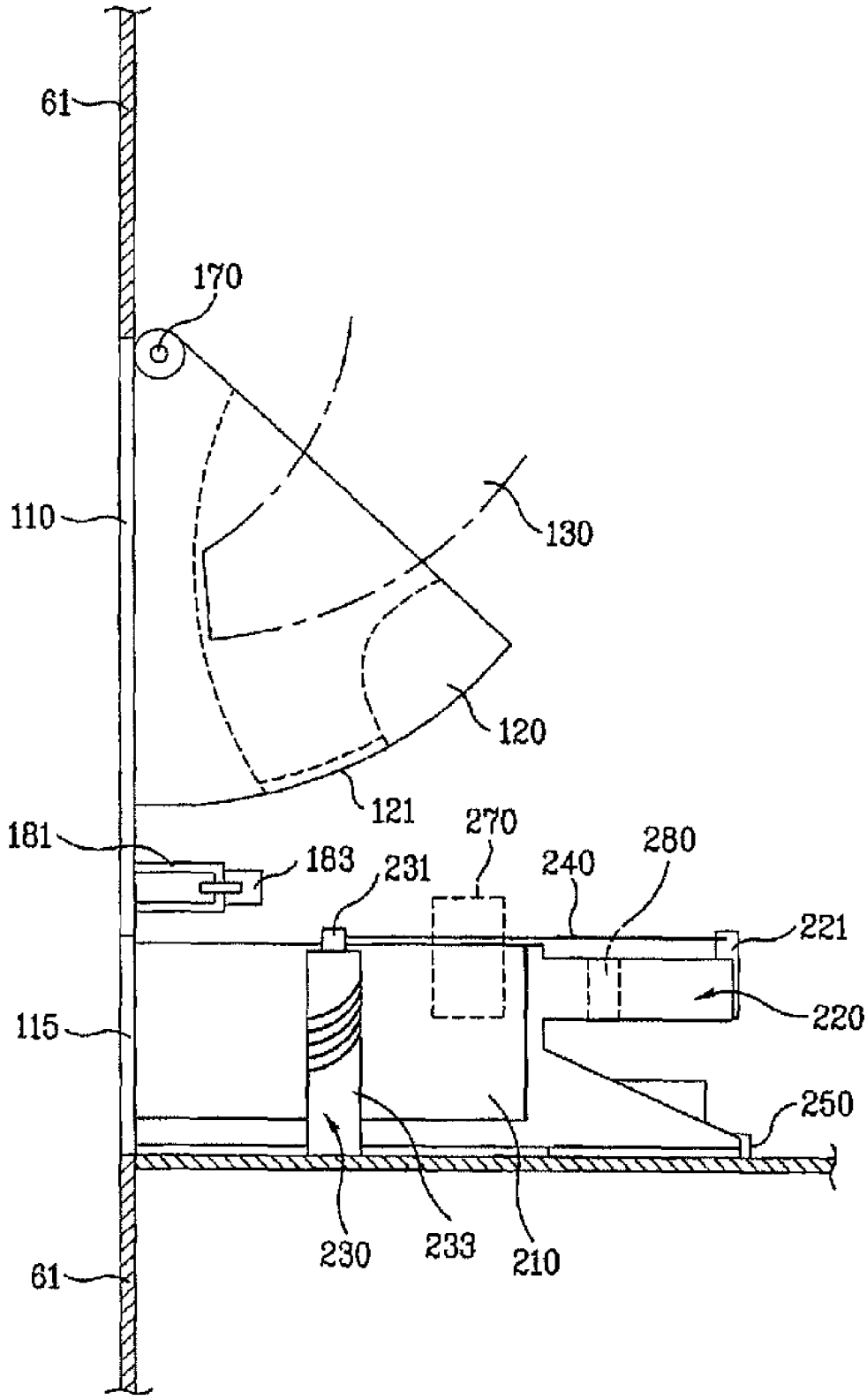

【Fig. 3b】
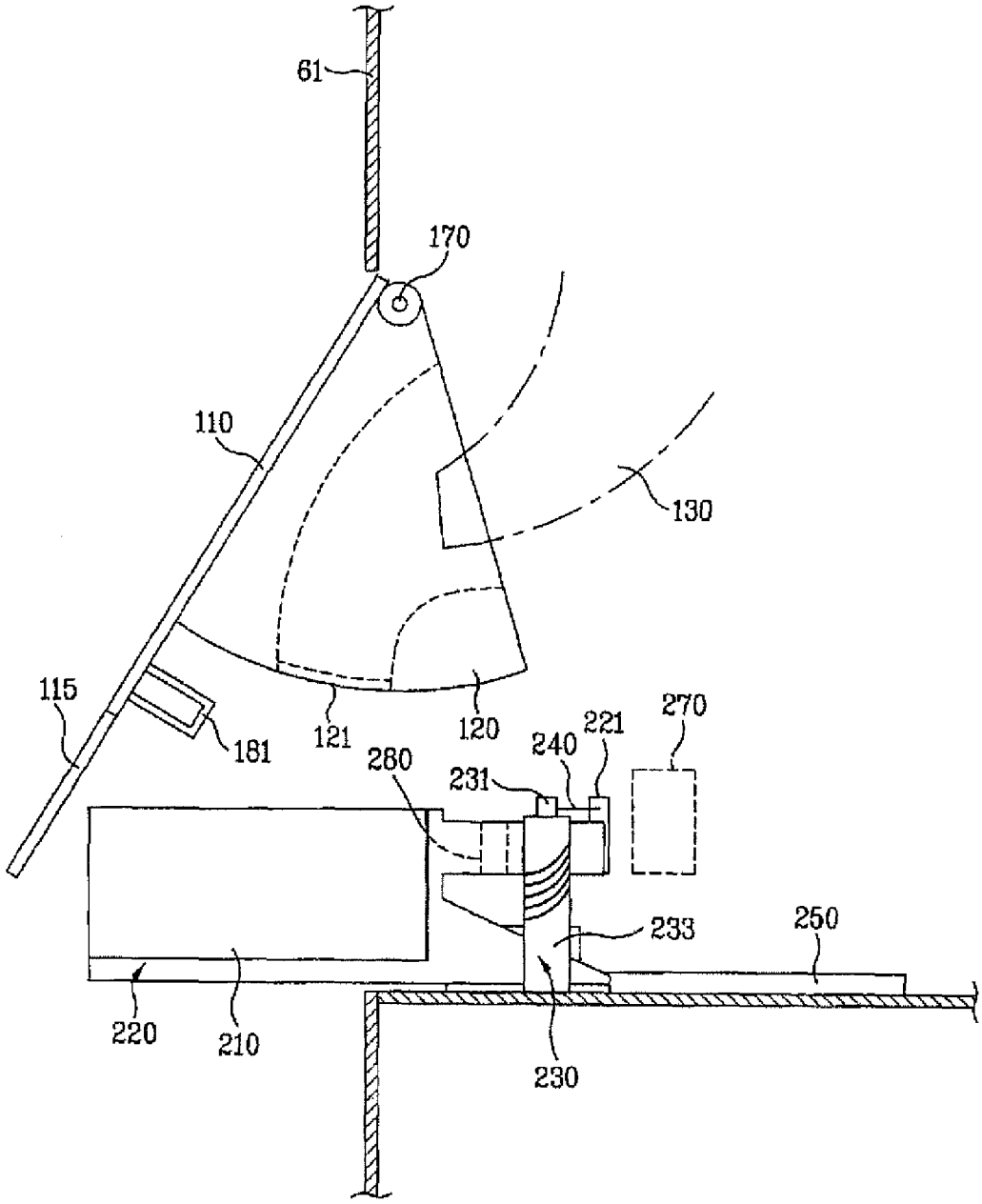

【Fig. 4a】
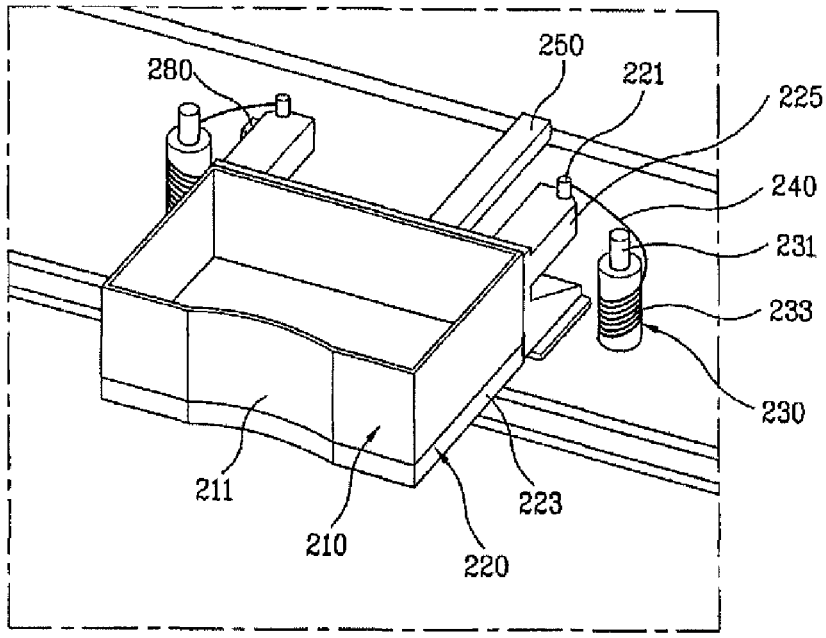
【Fig. 4b】
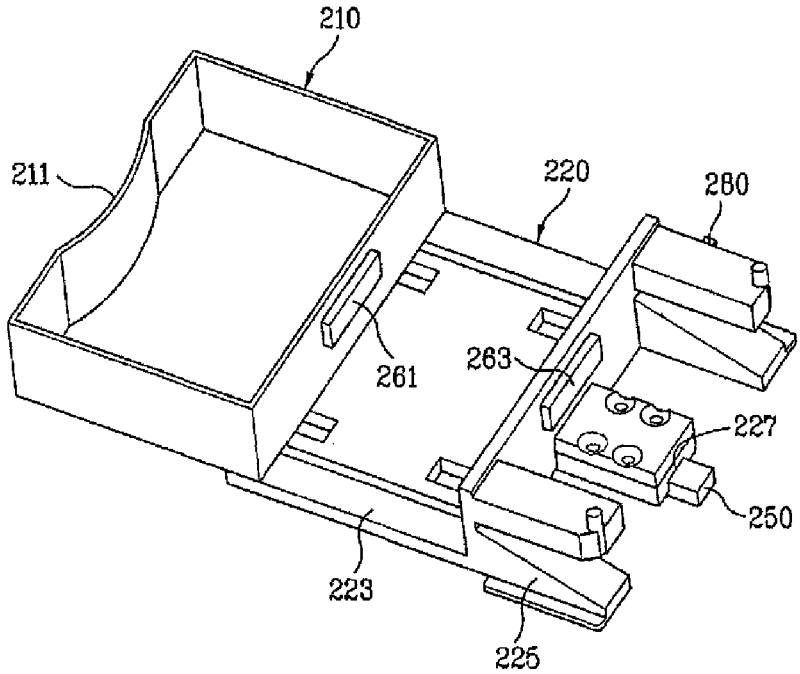

【Fig. 5A】
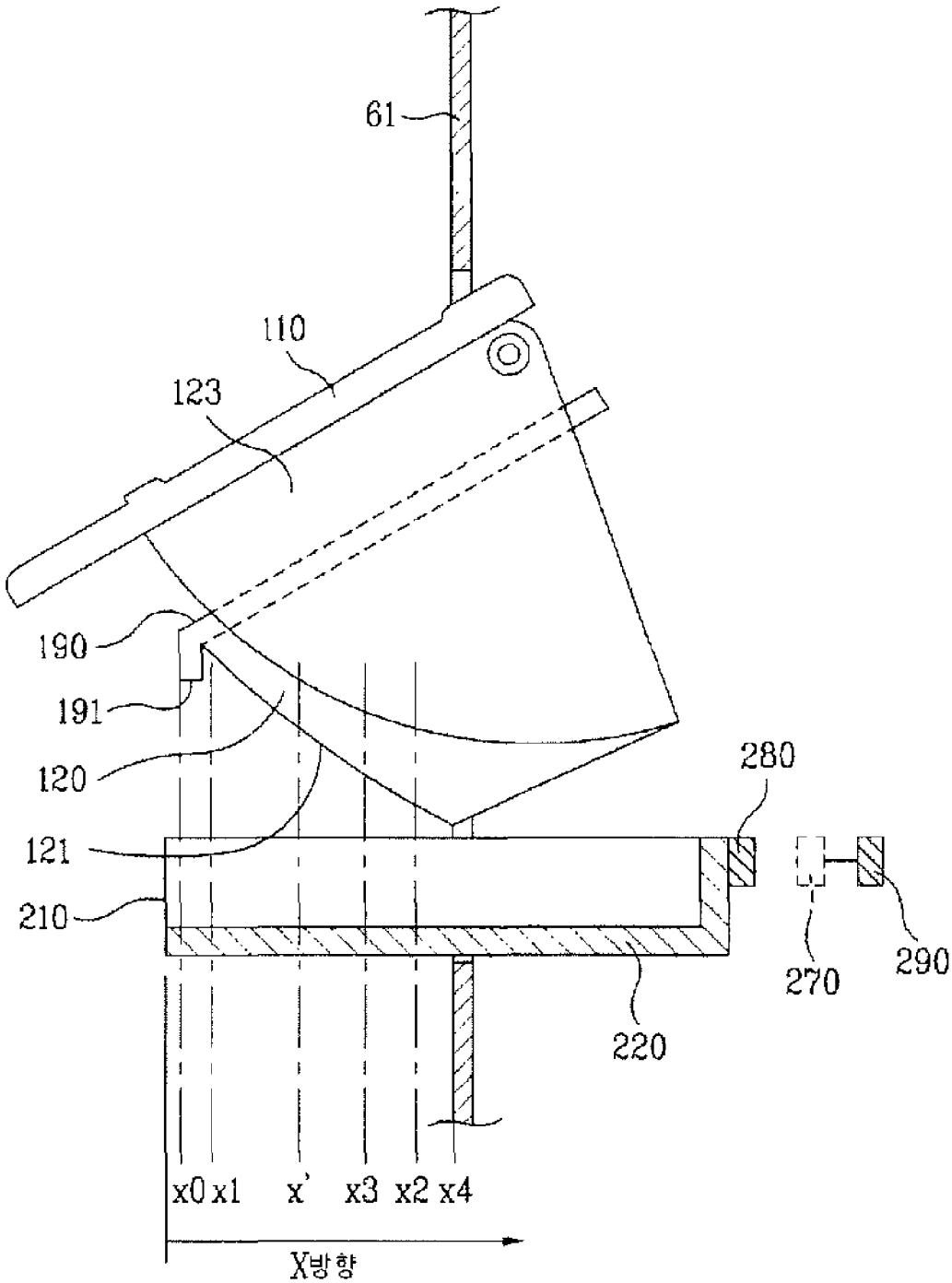

【Fig. 5B】
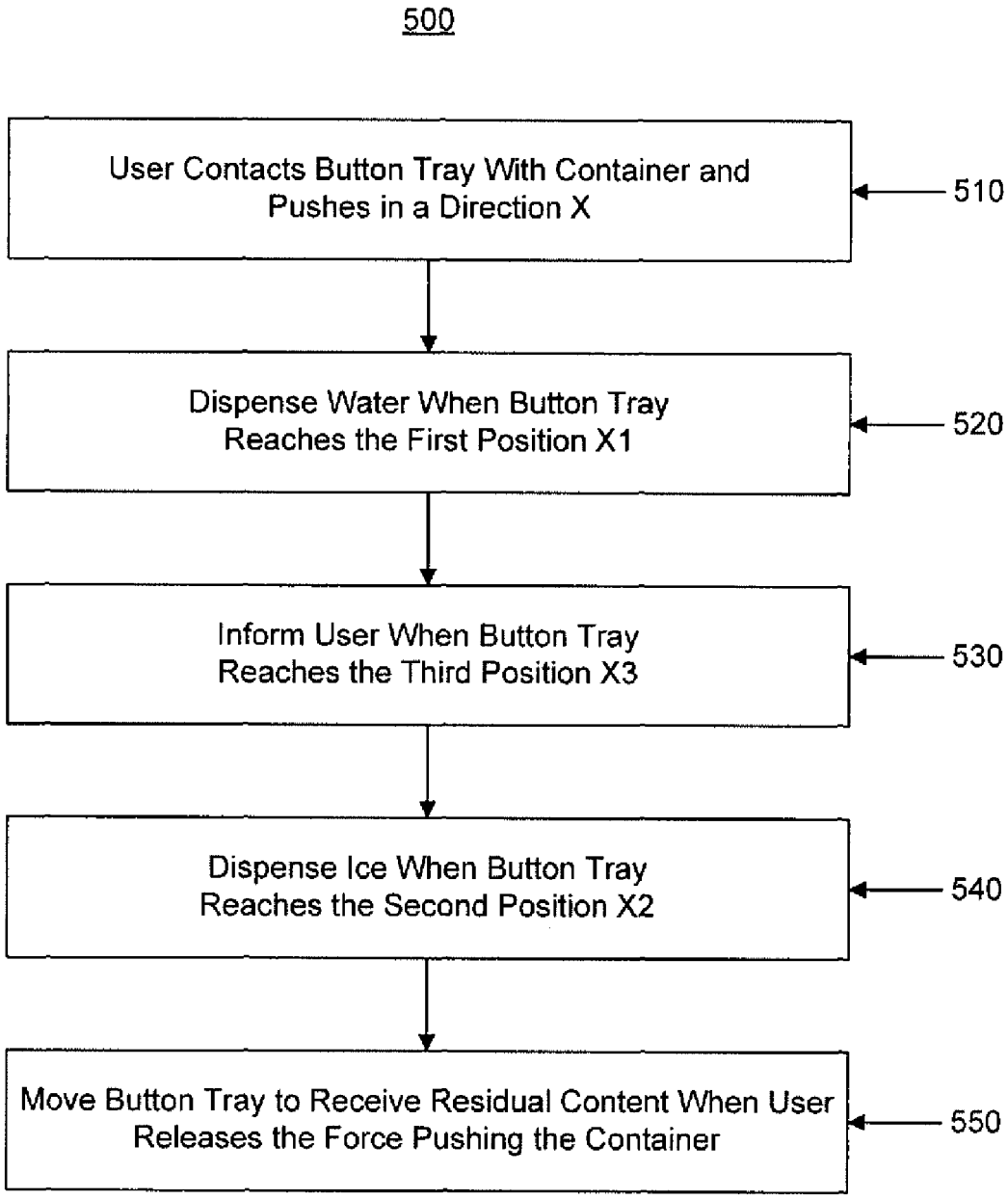

【Fig. 6】
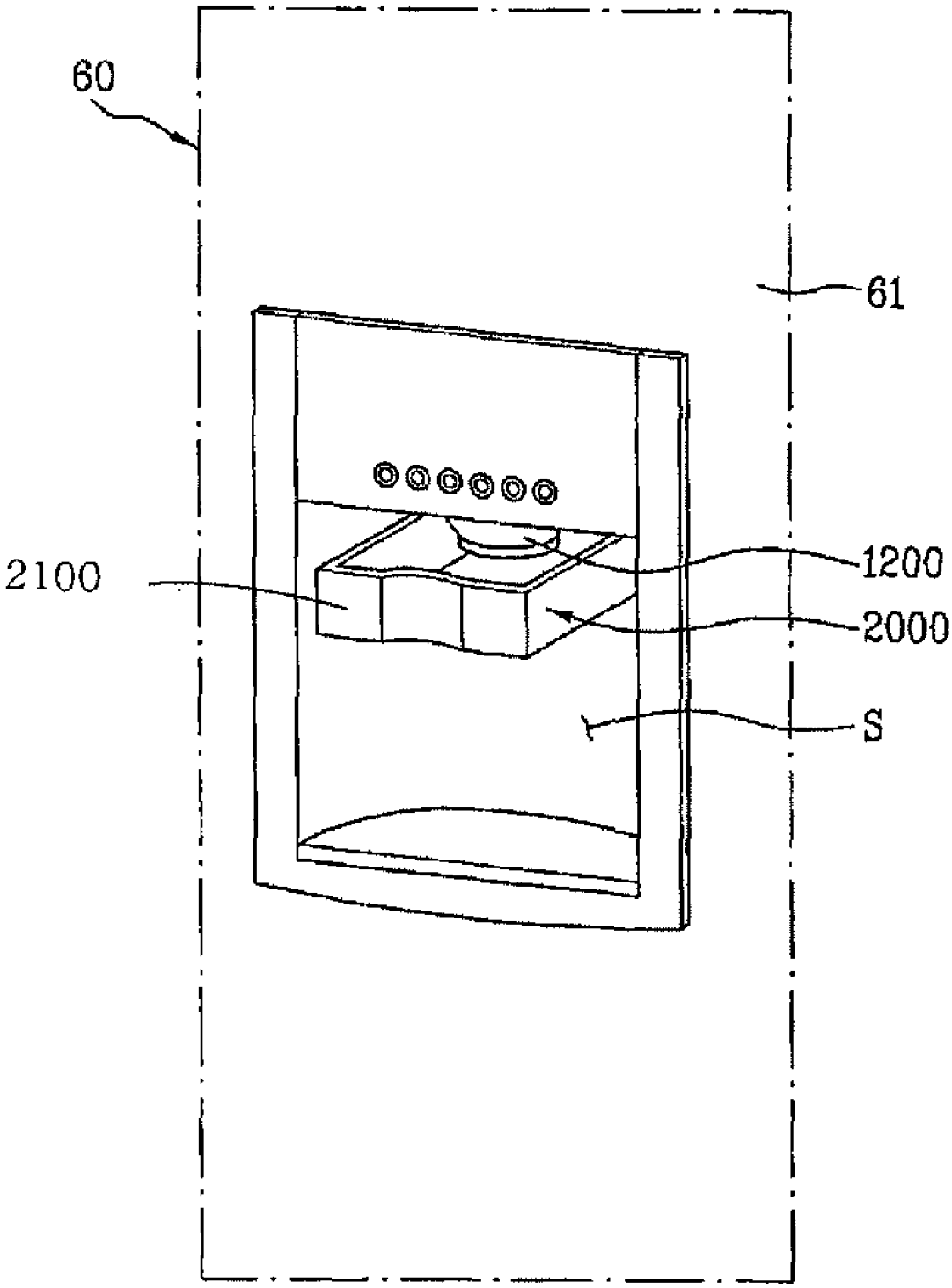

【Fig. 7】
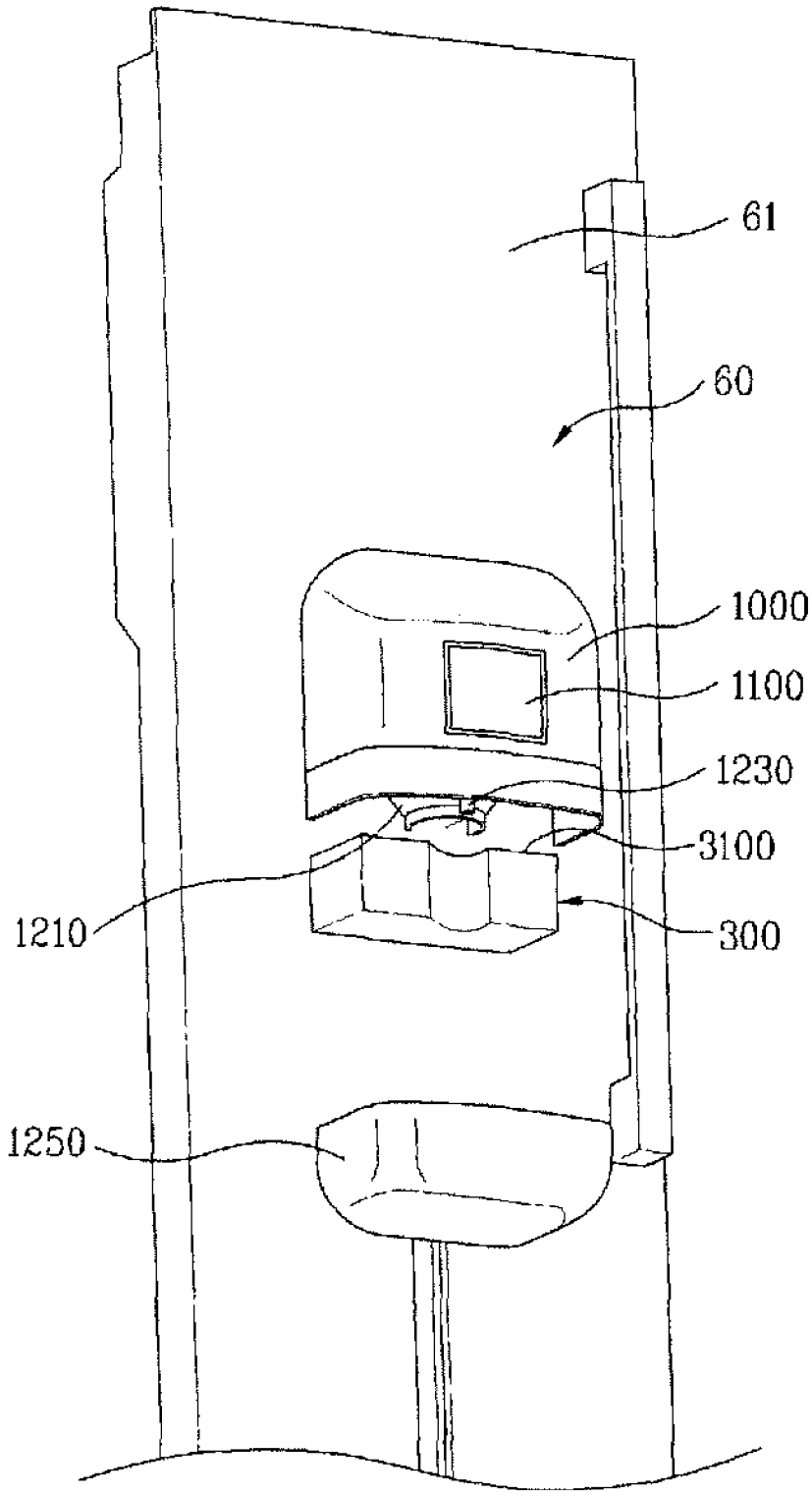

DISPENSER RELATED TECHNOLOGY

CROSS REFERENCE TO RELATED APPLICATIONS

This application claims the benefit of Korean Patent Application No. 10-2007-0068119, filed on Jul. 6, 2007, which is hereby incorporated by reference for all purposes as if fully set forth herein.

FIELD

The present disclosure relates to dispenser technology.

BACKGROUND

A refrigerator is a representative food storing apparatus. Generally, a refrigerator includes a freezing compartment and a refrigerating compartment. The refrigerating compartment is kept at a temperature of about 3 to 4° C., to store food and vegetables in a fresh state for a prolonged period of time. The freezing compartment is kept at a temperature of below zero, to store meat and other food in a frozen state. A refrigerator may include an ice maker configured to make ice and a dispenser configured to dispense liquid water and ice made by the ice maker.

SUMMARY

In one aspect, an appliance includes a compartment, a door configured to open and close at least a portion of the compartment, and a dispenser that is positioned on a surface of the door and having at least one dispenser outlet, the dispenser being configured to dispense at least first and second types of content. The appliance also includes a button tray configured to move, at least partially toward and away from the surface of the door, in response to application of force against the button tray, and a controller configured to respond to repositioning of the button tray by controlling a type of content dispensed by the dispenser based on a position of the button tray that results from movement of the button tray, the controller being configured to control the dispenser to dispense the first type of content in response to the button tray being moved to a first position and being configured to control the dispenser to dispense the second type of content in response to the button tray being moved to a second position that is different than the first position.

Implementations may include one or more of the following features. For example, the button tray may be configured to move along a path divided into multiple stages. The multiple stages may include a water dispensing stage in which the button tray is positioned in the water dispensing stage and the controller respectively controls the dispenser to dispense water, and an ice dispensing stage in which the button tray is positioned in the ice dispensing stage and the controller respectively controls the dispenser to dispense ice. The button tray may pass through the water dispensing stage to reach the ice dispensing stage, and the controller may be configured to reduce undesired dispensing of water while the button tray is being moved through the water dispensing stage to the ice dispensing stage. The controller also may be configured to reduce undesired dispensing of water while the button tray is being moved through the water dispensing stage to the ice dispensing stage by waiting until a position of the button tray has been maintained in the water dispensing stage for a predetermined amount of time prior to controlling the dispenser to dispense water.

In some examples, the appliance may include an input control configured to enable a user to select a type of content to dispense. The input control may be configured to enable the user to select at least one of water and ice, and the controller may be configured to, when the user has selected to dispense ice, prevent the dispenser from dispensing water when the button tray is positioned in the water dispensing stage.

In some implementations, the appliance may include a tray movement control mechanism configured to move the button tray away from the surface of the door in the absence of force applied to the button tray in a direction that is toward the surface of the door, and to change a position of the button tray from a misaligned position in which the button tray is misaligned with the at least one dispenser outlet to a receiving position in which the button tray is aligned with and captures content dispensed through the at least one dispenser outlet, where the tray movement control mechanism allows the button tray to move into the misaligned position in response to force that is applied to the button tray and where the control mechanism causes the button tray to move into the receiving position in response to removal of force that is applied to promote positioning of the button tray in the misaligned position. The tray movement control mechanism also may be configured to move the button tray away from the surface of the door by rotating the button tray away from the surface of the door about a pivot point.

The first position may be further from the surface of the door than the second position, and the controller may be configured to control the dispenser to dispense water in response to the button tray being moved to the first position and may be configured to control the dispenser to dispense ice in response to the button tray being moved to the second position. The at least one dispenser outlet may include a water outlet and an ice outlet, and the controller may be configured to control the dispenser to dispense water in response to the button tray being moved to the first position and may be configured to control the dispenser to dispense ice in response to the button tray being moved to the second position. A container may be positioned to receive content dispensed through the water outlet when the button tray is moved to the first position using the container, and the container may be positioned to receive content dispensed through the ice outlet when the button tray is moved to the second position using the container.

The appliance may include a first distance sensor mounted to the button tray and a second distance sensor arranged at a predetermined position in a space defined by a frame of the door. The first and second distance sensors may be configured to detect a position of the button tray. The appliance also may include an informing unit configured to generate an output that indicates a type of content being dispensed based on a position of the button tray that results from movement of the button tray. The informing unit may be configured to generate a sound or light that indicates the type of content being dispensed based on the position of the button tray.

The button tray also may be configured to move along a path divided into multiple stages. The multiple stages may include a water dispensing stage in which the controller controls the dispenser to dispense water when the button tray is positioned in the water dispensing stage, an ice dispensing stage in which the controller controls the dispenser to dispense ice when the button tray is positioned in the ice dispensing stage, and a transition stage defined between the water dispensing stage and the ice dispensing stage. The informing unit may be configured to generate a transition output when the button tray is positioned in the transition stage. The transition output may indicate movement of the button tray from the water dispensing stage to the ice dispensing stage.

In some examples, the at least one dispenser outlet may include a water outlet configured to dispense water and an ice outlet configured to dispense ice, and the water outlet may be arranged further from the compartment than the ice outlet. The appliance also may include a moving chute that is configured to move between an operable position in which the moving chute is at least partially positioned on a side of the surface of the door opposite of the compartment, and a stored position in which the moving chute is positioned entirely on a side the surface of the door where the compartment is positioned, where the moving chute has structure that defines at least a portion of a passage through which content is discharged from the dispenser.

The door may have at least a portion extending into a dispensing cavity that houses the dispenser positioned on the surface of the door, and the at least one dispenser outlet of the dispenser may be arranged in the dispensing cavity. The at least one dispenser outlet also may be positioned outside of a surface of the door that is furthest from the compartment. The appliance may include a lower tray that is attached to the surface of the door that is furthest from the compartment and, when the appliance is oriented in a normal operating orientation, is positioned beneath the at least one dispenser outlet. The lower tray may be configured to receive content dispensed out of the at least one dispenser outlet when the appliance is oriented in the normal operating orientation.

In another aspect, a method for controlling an appliance includes enabling movement of a button tray at least partially toward and away from a compartment of the appliance in response to application of force against the button tray, controlling a dispenser, which has at least one dispenser outlet and which is configured to dispense at least first and second types of content, to dispense the first type of content in response to the button tray being moved to a first position, and controlling the dispenser to dispense the second type of content in response to the button tray being moved to a second position that is different than the first position. Implementations may include one or more of the following features. For instance, the method may include generating an output that indicates a type of content being dispensed based on a position of the button tray that results from movement of the button tray. The method also may include moving, in response to release of a force that caused the button tray to move to at least one of the first and second positions, the button tray toward an original position in which the button tray is positioned to receive content dispensed by the dispenser to enable the button tray to receive a residual content dispensed by the dispenser. The method further may include coordinating movement, together with the button tray, of a moving chute that defines a content discharge passage and that is positioned above the button tray when the appliance is oriented in a normal operating position.

In some examples, the button tray may move through the first position to reach the second position, further comprising reducing undesired dispensing of the first type of content while the button tray is being moved through the first position to the second position. In these examples, the method may include reducing undesired dispensing of the first type of content while the button tray is being moved through the first position to the second position comprises waiting until a position of the button tray has been maintained in the first position for a predetermined amount of time prior to controlling the dispenser to dispense the first type of content.

In yet another aspect, an appliance includes a compartment, a door configured to open and close at least a portion of the compartment, and a dispenser that is positioned on a surface of the door and having at least one dispenser outlet, the dispenser being configured to dispense at least first and second types of content. The refrigerator also includes means for enabling movement of a button tray at least partially toward and away from the compartment of the appliance in response to application of force against the button tray, means for controlling the dispenser to dispense the first type of content in response to the button tray being moved to a first position, and means for controlling the dispenser to dispense the second type of content in response to the button tray being moved to a second position that is different than the first position.

DESCRIPTION OF DRAWINGS

FIG. 1 is a perspective view illustrating a food storing apparatus.

FIG. 2 is a perspective view of a part of the food storing apparatus of FIG. 1 corresponding to a front surface of a door, illustrating a state in which a dispenser included in the food storing apparatus is positioned in an operable position.

FIG. 3A is a sectional view illustrating a state in which a button tray composite device is positioned in a stored position.

FIG. 3B is a sectional view illustrating a state in which a button tray composite device is positioned in an operable position.

FIG. 4A is a perspective view illustrating a button tray composite device.

FIG. 4B is an exploded perspective view illustrating a button tray composite device.

FIG. 5A is a sectional view illustrating a path of movement of a button tray.

FIG. 5B is a flow chart of a process for sequentially dispensing water and ice.

FIG. 6 is a perspective view of a part of a food storing apparatus illustrating a front surface of a door.

FIG. 7 is a perspective view of a part of a food storing apparatus illustrating a front surface of a door.

DETAILED DESCRIPTION

FIG. 1 illustrates a food storing apparatus, such as a refrigerator. The refrigerator includes a freezing compartment configured to store food at a temperature below freezing and a refrigerating compartment configured to store food at a cool temperature that is higher than freezing. The refrigerator includes a freezing compartment door 50 arranged at a front side of the freezing compartment and configured to open and close the freezing compartment and refrigerating compartment doors 60 and 70 arranged at a front side of the refrigerating compartment and configured to open and close the refrigerating compartment. The freezing compartment is positioned beneath the refrigerating compartment when the refrigerator is oriented in a typical operating position. The refrigerating compartment may be divided into two blocks.

In implementations in which the refrigerating compartment is divided in two blocks, the refrigerating compartment includes a first refrigerating compartment and a second refrigerating compartment. In these implementations, the refrigerating compartment door 60 is a first refrigerating compartment door configured to open and close the first refrigerating compartment, whereas the refrigerating compartment door 70 is a second refrigerating compartment door configured to open and close the second refrigerating compartment. The first and second refrigerating compartment doors 60 and 70 are pivotally coupled to opposite side walls of a refrigerator body by hinges such that the doors 60 and 70 may be pivotally opened and closed. The freezing compartment door 50 is opened and closed in a sliding manner in forward and rearward directions of the refrigerator body.

The freezing and refrigerating compartment doors may be arranged at various positions in accordance with the positions of the freezing and refrigerating compartments. For example, the refrigerator may include various styles of refrigerators, for example, a refrigerator with a top mount freezing compartment and side-by-side style refrigerators that include side-by-side refrigerating and freezing compartments.

A dispenser 100 is located at a front side of the refrigerating compartment door 60, and configured to dispense certain content, such as, water or ice. A button tray composite device 200 is located beneath the dispenser 100, and configured to receive a residual content left in the dispenser 100 after dispensation of water or ice.

FIG. 2 illustrates a part of the food storing apparatus of FIG. 1 corresponding to a front surface of a door. As shown in FIG. 2, the dispenser is positioned in an operable position.

The first refrigerating compartment door 60 includes a front frame 61 and a rear frame 63. The front frame 61 is partially exposed to the outside of the refrigerator, whereas the rear frame 63 is partially exposed to the inside of the refrigerator body when the refrigerating compartment door 60 is positioned in a closed position.

A space is defined between the front frame 61 and the rear frame 63. In the space, an ice maker (not shown), which produces ice, an ice storing container (not shown), which stores the ice produced by the ice maker, and a water tank, which stores water, are installed. In some examples, the ice maker, ice storing container, and water tank may be installed in the refrigerator body, or installed at the freezing compartment door 50.

The dispenser 100 is positioned on the door and at least a portion of the dispenser is configured to fit in the space defined between the front frame 61 and the rear frame 63 when the dispenser is positioned in a stored position. The dispenser 100 also is connected to the water tank and ice storing container to receive water or ice for dispensing.

The dispenser 100 includes a moving chute 120 configured to move between a stored position and an operable position. In the operable position, at least a portion of the moving chute 120 is positioned outside of the front frame 61, and the moving chute 120 is configured to define a passage for discharging ice through the door. In the stored position, at least a portion of the moving chute 120 is positioned in the space defined between the front frame 61 and the rear frame 63. The dispenser 100 also includes a dispensing cover 110, which may be configured to move between a stored position and an operable position together with the moving chute 120. In the stored position, the dispensing cover 110 may be positioned flush with a surface of the door.

Control buttons 113 and a display 111 are arranged on the dispensing cover 110. The control buttons 113 control various dispenser and/or refrigerator functions. For instance, the control buttons 113 may control a selection of content for dispensing, for example, selection of ice or water. The display 111 displays a content dispensation state and any other information related to the dispenser 100 or the refrigerator.

A transparent panel 115 is positioned on the dispensing cover 110, to allow a user to visually check the button tray composite device at an outside of the refrigerator. Through the transparent panel 115, the user may visually check how much content discharged through an outlet included in the moving chute 120 is received in a container. The transparent panel 115 enables a user to view ice or water being dispensed into a container to ensure the container is positioned such that the ice or water being dispensed is received in the container and also to determine when to stop dispensing because the container has been filled to a desired level.

In some implementations, a separate illumination device may be installed in an inner space of the door. In these implementations, the illumination device may operate to emit light, only when content (e.g., ice or water) is being dispensed, in order to allow the user to check how much content is received in a container. Further, in these implementations, the dispensing cover 110 may be made of a material that allows light to pass through the dispensing cover 110.

As shown in FIG. 2, the dispensing cover 110 and moving chute 120 are structurally connected (e.g., integrated). For instance, the dispensing cover 110 and moving chute 120 constitute a single dispensing housing. The dispensing cover 110 defines an external appearance of the dispensing housing, whereas the moving chute 120 defines an interior of the dispensing housing. In these configurations, the dispensing cover 110 and moving chute 120 move together. In particular, the moving chute 120 moves to enter or exit the inner space of the door.

FIG. 3A illustrates a button tray composite device in a stored position and FIG. 3B illustrates a button tray composite device in an operable position. The dispenser 100 includes a fixed chute 130 having a first end that communicates with the moving chute 120, and a second end that communicates with the ice storing container, which stores ice. The fixed chute 130 is positioned in the space defined between the front frame 61 and the rear frame 63. The fixed chute 130 is fixed in the space by fasteners (not shown), for example, bolts and nuts, or hooks.

The moving chute 120 has a length enabling the moving chute 120 to communicate with the fixed chute 130 during movement of the moving chute 120, irrespective of whether the moving chute 120 is positioned in an operable position outside of the front frame 61 or in a stored position in the inner space of the door defined between the front frame 61 and the rear frame 63.

An ice discharge duct (not shown) may be positioned in the space defined between the front frame 61 and the rear frame 63, to define an ice flow passage from the ice storing container to the fixed chute 130. A duct cover (not shown) may be located at an end of the ice discharge duct that communicates with the fixed chute 130, and configured to open and close the ice discharge duct.

A mechanical drive mechanism is provided at the refrigerating compartment door 60. The mechanical drive mechanism is configured to move the dispensing cover 110 and moving chute 120 from a stored position to an operable position in which the dispensing cover 110 and moving chute 120 are positioned outside of the front frame 61.

The mechanical drive mechanism includes a hinge 170 that allows the dispensing cover 110 connected to the moving chute 120 to pivot or rotate with respect to the front frame 61, and an elastic device (not shown) that provides an elastic force to the dispensing cover 110 and moving chute 120 to promote movement of the dispensing cover 110 and moving chute 120 from the stored position to the operable position in which the dispensing cover 110 and moving chute 120 are positioned outside of the front frame 61. The mechanical drive mechanism also includes a coupling unit that couples the dispensing cover 110 to the front frame 61 against the elastic force provided by the elastic device, thereby retaining the dispensing cover 110 and moving chute 120 in the stored position when the coupling unit is engaged.

The coupling unit includes a first coupler 181 mounted to the dispensing cover 110, and a second coupler 183 mounted in the inner space of the door. The first and second couplers 181 and 183 operate to be engaged or separated from each other, upon receiving a force from a user.

For example, when the first and second couplers 181 and 183 are simultaneously pressed, a coupling hook provided at the second coupler 183 is separated from a coupling groove provided at the first coupler 181. When the first coupler 181 is separated from the second coupler 183 and pressed, the coupling hook engages the coupling groove, thereby coupling the first coupler 181 to the second coupler 183.

The mechanical drive mechanism may further include a damper (not shown) for adjusting the speed of the dispensing cover during the movement of the dispensing cover 110. The damper may be any device configured to apply a constant force to the dispensing cover 110 and moving chute 120 such that the dispensing cover 110 and moving chute 120 pivot at a constant speed. For example, a gas spring or a gearing may be used, which may apply a relatively constant force to the dispensing cover 110 and moving chute 120 against the pivotal movement of the dispensing cover 110 and moving chute 120.

The hinge 170 includes hinge pins (not shown) respectively located at opposite ends of the dispensing cover 110, and hinge grooves (not shown) located at an inner surface of the front frame 61 such that the hinge grooves correspond to the hinge pins, respectively. Accordingly, the dispensing cover 110 and moving chute 120 pivot about the hinge pins.

The refrigerator further may include a water discharge duct (not shown) coupled to the dispensing cover 110, and configured to discharge water. When the dispensing cover 110 and moving chute 120 are in an operable position outside of the front frame 61 (e.g., in a water dispensing mode), the water discharge duct (not shown) coupled to the dispensing cover 110 is positioned together with the dispensing cover 110 and moving chute 120, so that water can be discharged out of an outlet of the water discharge duct outside of the front frame 61.

The button tray composite device 200, which is located beneath the dispenser 100, controls the dispensation of content (e.g., ice or water) discharged out of an outlet 121 of the moving chute 120. The button tray composite device 200 also is configured to receive a residual content discharged from the outlet 121 after the completion of a content dispensing operation.

A controller (not shown) is located at one side in the inner space of the door. The controller includes a dispensing switch 270 configured to control dispensation of content, in cooperation with the button tray composite device 200.

The button tray composite device 200 includes a button switch 280 that is selectively connectable to the dispensing switch 270 to control the dispensation of the content. The button tray composite device 200 also includes a button tray 210 having a content receiving space configured to receive content (e.g., residual content after a dispensing operation) from the outlet 121 when the button tray 210 is positioned in an extended position corresponding to and positioned under the outlet 121. The button tray composite device 200 further includes a tray driving mechanism configured to move the button tray 210.

The button tray composite device 200 includes a guide member 250 configured to guide the movement of the button tray 210. A moving member 220, which may be selectively coupled to the button tray 210, is configured to move, together with the button tray 210, while being guided by the guide member 250.

FIG. 4A illustrates a button tray composite device and FIG. 4B is an exploded perspective view illustrating a button tray composite device. As shown, the button tray 210, which has the content receiving space configured to receive a residual content, also has a front panel having a curved portion 211 that allows the front panel to easily come into contact with a container to receive the dispensed content. The curved portion 211 defines a concave space in the button tray 210 that is shaped to accommodate a portion of a typical container such that the button tray may be effectively contacted with and thus actuated by a container.

The moving member 220 includes a bottom wall 223 that defines a bottom of the button tray 210, and supports the bottom of the button tray 210. A rear wall 225 is connected to (e.g., integrated with) the bottom wall 223, and supports the rear side of the button tray 210.

A guide groove 227 is defined (e.g., formed) in the bottom wall 223 of the moving member 220, at a lower surface thereof, and corresponds to the guide member 250. When the moving member 220 moves, the guide groove 227 of the moving member 220 slides along the guide member 250, thereby guiding the movement of the moving member 220.

The button tray 210 is coupled to the moving member 220 by a coupler. Accordingly, when an external force is applied to the button tray 210, the moving member 220 is moved, together with the button tray 210.

In some implementations, the coupler includes a first coupling member 261, which is mounted to a rear panel of the button tray 210, and has magnetic properties, and a second coupling member 263 mounted to the rear wall 225 of the moving member 220. The second coupling member 263 may be coupled to the first coupling member 261 by a magnetic force generated from the first coupling member 261. The first coupling member 261 may comprise a permanent magnet or an electromagnet, whereas the second coupling member 263 may comprise a permanent magnet, an electromagnet, or a metallic member.

In other examples, the coupling between the moving member 220 and the button tray 210 may be achieved using another coupling method that enables the moving member 220 and the button tray 210 to be coupled and uncoupled. For example, the moving member 220 and button tray 210 may be coupled by a hook coupling method or a thread coupling method.

The button switch 280 is mounted to the moving member 220 such that it is selectively connectable to the dispensing switch 270. For example, when the button switch 280 comes into contact with the dispensing switch 270 as the moving member 220 moves, the dispensing switch 270 generates a signal, and sends the generated signal to the controller. In response to the signal, the controller controls the dispensation of the content (e.g., ice, water, etc.).

The tray drive mechanism includes an elastic member having an elastic resilience against an external force applied to the button tray 210. A wire spring may be used for the elastic member.

The tray drive mechanism includes a roller 230 installed at one side in the interior of the door, and a wire spring 240 wound around the roller 230. The wire spring 240 is unwound from the roller 230 when an external force is applied to the tray drive mechanism, and is wound around the roller 230 when the external force is released. When the wire spring 240 is wound around the roller 230, it applies a force that moves the button tray 210. As shown in FIG. 4*a*, the tray drive mechanism includes a pair of rollers 230 installed at opposite sides in the interior of the door, and a pair of wire springs 240 wound around the rollers 230, respectively. Although the description focuses on a single roller 230 and a single wire spring 240, the described techniques may be applied when two or more rollers and wire springs are used.

The wire spring 240 is coupled, at one end thereof, to a spring support 221 provided at the moving member 220, and is coupled, at the other end thereof, to the roller 230. The roller 230 includes a rotating body 233, and a rotating shaft 231 that defines a rotating axis of the rotating body 233. The tray drive mechanism may further include a torsion spring (not shown) mounted to the roller 230, to return the rotating body 233 from a rotated state (e.g., a state in which the wire spring 240 is unwound) to an original state (e.g., a state in which the wire spring 240 is wound around the rotating body 233).

In accordance with the above-described configuration, when the button tray 210 moves in response to an external force applied thereto (e.g., a force applied by a user), the moving member 220 that is coupled to the button tray 210 moves together with the button tray 210. During movement of the moving member 220, the wire spring 240 coupled to the moving member 220 is made tense. Namely, a tension is applied to the wire spring 240, so that the wire spring 240 is gradually unwound from the roller 230 due to rotation of the roller 230 caused by the tension.

When the external force is subsequently released, the wire spring 240 is wound around the roller 230 by the resilience of the wire spring 240 or torsion spring. At this time, the moving member 220 coupled to the wire spring 240 moves to an original position where the moving member 220 was positioned before the application of the external force.

The elastic member that provides resilience to the tray may have any shape. For example, a spring having a structure different from the above-described structure, such as a coil spring or a plate spring, may be used for the elastic member.

In some implementations, the elastic member may be arranged such that one end thereof is coupled to the moving member, and the other end thereof is positioned in the inner space of the door. In these implementations, when the button tray 210 is pushed into the inner space of the door by an external force (e.g., a force applied by a user with a container), the elastic member is completely positioned in the inner space of the door in a compressed state. In the compressed state, the elastic member has a resilience that, when the external force is removed from the button tray 210, causes the elastic member to return to an original or uncompressed state while pushing the button tray 210 in a direction outside of the inner space of the door.

The operation of the button tray composite device will be described below with reference to FIGS. 2 to 4*b*.

When a user desires to dispense content, e.g., ice or water, the user presses the lower end of the dispensing cover 110. For instance, the user presses a portion of the dispensing cover 110 that corresponds to a position where the couplers 181 and 183 that couple the dispensing cover 110 to the front frame 61 are arranged.

In response to the user pressing the portion of the dispensing cover 110, the dispensing cover 110 and button tray 210 simultaneously move outward from the front frame 61. At this time, the dispensing cover 110 is protruded outwardly from the front frame 61 by the resilience of the elastic device mounted to the moving chute drive mechanism, and the button tray 210 is protruded outwardly from the front frame 61 by the resilience of the elastic member included in the tray drive mechanism, e.g., the wire spring 240.

When the user subsequently brings a container into contact with the button tray 210, and pushes the button tray 210 in a direction into the door with the container, the moving member 220 coupled to the button tray 210 is moved in the direction into the door along the guide member 250, together with the button tray 210. During the movement of the moving member 220, the wire spring 240 is unwound from the roller 230 in accordance with the movement of the moving member 220.

When the moving member 220 reaches a predetermined position, the button switch 280 mounted to the button tray 210 contacts or connects with the dispensing switch 270 arranged in the interior of the door. In response to a signal generated in response to the connection between the button switch 280 and the dispensing switch 270, the controller performs a control operation to dispense content (e.g., ice or water) through the outlet 121.

In this example, the controller controls dispensing of content in such a manner that the content is dispensed through the outlet 121 only when the moving chute 120 is positioned in an operable position (e.g., rotated outside of the front frame 61). That is, the content is not dispensed when the moving chute 120 and button tray 210 are arranged in the interior of the door, even if the button switch 280 mounted to the button tray 210 contacts or connects with the dispensing switch 270.

The signal may be generated, based on information including the contact time of the connection between the button switch 280 and the dispensing switch 270 or the contact position. For instance, content may be dispensed as long as the connection between the button switch 280 and the dispensing switch 270 remains. In some examples, dispensing of content does not begin until the connection between the button switch 280 and the dispensing switch 270 has existed for a threshold period of time (e.g., one second). In these examples, dispensing of content is delayed for the threshold period of time, which may avoid content from being dispensed as a result of an inadvertent movement of the button tray 210.

In other examples, the dispensing of content does not begin until the button switch 280 contacts the dispensing switch 270 at a particular portion of the dispensing switch 270. For example, dispensing of content may not occur until the button switch 280 contacts a rear portion of the dispensing switch 270 positioned further into the door. In this example, dispensing of content occurs for relatively large movement of the button tray 210, but does not occur for relatively small movement of the button tray 210, which may avoid content from being dispensed as a result of an inadvertent movement of the button tray 210.

An amount or a rate of content being dispensed by the dispenser also may be controlled using the button tray 210. For example, depending on the position of the button tray 210, the dispensing of content may be regulated from among at least three settings (e.g., an off setting, a fully on setting, and a partially on setting). In this example, no movement of the button tray 210 may result in a first setting in which content is not dispensed, a relatively small movement of the button tray 210 may result in a second setting in which content is dispensed at a first rate, and a relatively large movement of the button tray 210 may result in a third setting in which content is dispensed at a second rate that is different than the first rate. The second rate may be larger than the first rate and allow a container to be filled more quickly in response to a relatively large movement of the button tray.

When the user releases the container, in which the content has been received, from the button tray 210 after a dispensing operation, the moving member 220 and button tray 210 move, by the resilience of the wire spring 240, to the original positions thereof (e.g., positions prior to the movement caused by user application of force with the container in performing the dispensing operation). The original position may be a position beneath the outlet 121.

When the button tray 210 is returned to the original position beneath the outlet 121, a residual content discharged out of the outlet 121 just after the dispensation of the content is received and contained in the button tray 210. Accordingly, the residual content is not dropped onto the floor.

In other words, the button tray 210 moves from a position in which the button tray 210 is misaligned with the outlet 121 to a position in which the button tray 210 is aligned with the outlet 121. In the misaligned position, the button tray 210 is not configured to receive content discharged from the outlet 121. However, in the aligned position, the button tray 210 is configured to receive content discharged from the outlet 121. By moving the button tray 210 from the misaligned position to the aligned position after dispensing of content (e.g., as or after a user removes force supplied with a container to the button tray 210), the button tray 210 may receive residual content dispensed through the outlet 121 in the aligned position. In the aligned position otherwise unguided content dispensed for the outlet 121 falls into the button tray 210 in an ordinary operating orientation and use of the food storing apparatus/refrigerator, and in the misaligned position otherwise unguided content dispensed for the outlet 121 falls into the button tray 210 in an ordinary operating orientation and use of the food storing apparatus/refrigerator.

Movement of the button tray 210 may follow a path different from the path of the button tray 210 described above. As described above, the button tray 210 retracts and extends toward and away from a surface of the door in a plane perpendicular to the door surface. In some implementations, the button tray 210 also may rotate or pivot toward and away from the door surface about a pivot point or extend and retract in a plane that is not perpendicular to the door surface.

When the user subsequently pushes the dispensing cover 110 in a direction into the door such that the moving chute 120 and button tray 210 are inserted into the inner space of the door, the couplers 181 and 183 are coupled to each other, so that the dispensing cover 110 is coupled to the front frame 61 in a stored position. Even in the stored position, the button tray 210 may receive a residual content, which may be discharged out of the outlet 121, because the button tray 210 may remain positioned beneath the outlet 121.

Thus, the button tray 210 may reliably receive a residual content that occurs after a dispensing operation because the button tray 210 may always be positioned beneath the outlet 121 (or in another position in which the button tray 210 receives content dispensed from the outlet 121), irrespective of whether the button tray 210 is positioned in an operable position protruded outwardly from the front frame 61 or in a closed position inserted into the inner space of the door.

FIG. 5A illustrates a path of movement of a button tray. Operations for dispensing different contents (e.g., ice and water) in accordance with different positions of the button tray movement are described below with reference to FIG. 5A.

The following description discusses an example in which the food storing apparatus is a refrigerator, and the different contents are water and ice. Other examples are within the scope of the disclosure.

A refrigerator may include a door, a dispenser that is installed at the door and that is configured to dispense water or ice, a button tray 210 movable to enable user control of dispensing the content (e.g., water or ice), and a controller that controls dispensing of the content based on a signal generated in accordance with the moved position of the button tray 210.

The controller may perform a control operation to dispense different contents in accordance with different moved positions of the button tray 210. For example, the controller enables selective dispensation of water or ice in accordance with the moved position of the button tray 210.

The selection of a desired content (e.g., from among water, ice, and a mixture of water and ice) may be determined before dispensing of the content. For instance, a control button ("113" in FIG. 2) arranged at the front surface of the door may be used to select a desired content. The control button may include a button for simultaneously dispensing water and ice, a button for dispensing water, and a button for dispensing ice.

In order to receive a residual content discharged out of a water outlet 191 or an ice outlet 121 after dispensing of water or ice, the button tray 210 may move toward the associated outlet after the dispensing of water or ice.

The water outlet 191 may be arranged in front of the ice outlet 121 in a direction toward the front surface of the door. In accordance with this arrangement, ice discharged out of the ice outlet 121 may be prevented from striking an end of the water outlet 191.

An informing unit 290 may be installed at one side of the door, to inform the user of the dispensation of water or ice, during the movement of the button tray 210. When the button tray 210 reaches a predetermined position, the informing unit 290 outputs, to the user, information representing the dispensation of water or ice, using a signal such as sound, voice, light, etc.

For example, the informing unit 290 may comprise a light source emitting light able to be visually recognized by the user at the outside of the refrigerator. The informing unit 290 also may comprise a speaker outputting a sound or voice able to be audibly recognized by the user at the outside of the refrigerator.

Alternatively, the informing unit 290 may comprise a cam device movable in accordance with the movement of the button tray 210. For example, the cam device includes first and second snapping cams, which move relative to each other in accordance with the movement of the button tray 210, and have respective stepped portions generating a snapping sound when the button tray 210 reaches a predetermined position.

The moved position of the button tray 210 may be calculated by an interaction between the button switch 280 mounted to the rear wall of the moving member 220, which moves together with the button tray 210, and the dispensing switch 270 installed in the inner space of the door.

For example, the button switch 280 and dispensing switch 270 may function as distance sensors. That is, the button switch 280 may comprise a first distance sensor mounted to a rear wall of the moving member, whereas the dispensing switch 270 may comprise a second distance sensor arranged at a certain fixed position in the inner space of the door. In this example, when the first distance sensor moves, it interacts with the second distance sensor, to sense the movement distance of the button tray 2100.

The controller controls the opening/closing of the water discharge duct and ice discharge duct, for the dispensation of water or ice, in accordance with the moved position of the button tray 210. Opening/closing the water discharge duct may include opening/closing a valve that controls water supply through the water discharge duct. Opening/closing the ice discharge duct may include opening/closing an obstruction member or cover that is positioned within or at an end of the ice discharge duct and that is arranged to block or open a path defined by the ice discharge duct. The controller also controls the informing unit 290 during the movement of the button tray, in order to enable the user to recognize the dispensation of water or ice.

The X-axis indicated in FIG. 5A represents the movement direction of the button tray 210 when the button tray 210 is being pressed to control dispensing of water or ice. In FIG. 5A, "X0" represents the distance from a front end of the button tray 210 to the position of the water outlet 191 when the water discharge duct 190 is positioned outside of the front surface of the door.

"X1" represents the position of the front end of the button tray 210 at which the controller controls dispensing of water out of the water outlet 191 (hereinafter, referred to as a "first position"). "X2" represents the position of the front end of the button tray 210 at which the controller controls dispensing of ice out of the ice outlet 121 (hereinafter, referred to as a "second position").

A switch, which determines whether or not water should be dispensed, is turned on/off at the first position of the button tray 210, whereas the switch, which determines whether or not ice should be dispensed, is turned on/off at the second position of the button tray 210. The content dispensing times for water and ice dispensed in accordance with the turning-on/off of the switches are previously stored in the controller.

"X3" represents the position of the front end of the button tray 210 at which the informing unit 290 operates (hereinafter, referred to as a "third position"). "X4" represents the position of an end of the ice outlet 121 at which ice is discharged out of the ice outlet 121.

The path of movement of the button tray 210 may be divided into a plurality of stages. The stage from X1 to X3 is a stage in which water may be dispensed, the stage from X3 to X2 is a stage in which, during the movement of the button tray, information as to the dispensation of water or ice is outputted, to enable the user to recognize, which content (or a change in which content) is being controlled by the button tray 210. The stage from X2 to X4 is a stage in which ice may be dispensed.

FIG. 5B illustrates a process 500 for sequentially dispensing water and ice. The movement path of the button tray 210 to sequentially dispense water and ice, in a state in which the button tray and moving chute are positioned outside of the front surface of the door is described below with respect to FIG. 5B and the positions illustrated in FIG. 5A.

First, the user pushes a container to receive water or ice, in a direction X, while bringing the container into contact with the curved portion ("211" in FIG. 4A) of the button tray 210 (510).

In accordance with the moved position of the button tray 210, water or ice is then dispensed. During the movement of the button tray 210, the dispensation of water or ice is informed to the user, in order to enable the user to recognize the content dispensation.

For example, when the button tray 210 reaches the first position X1, the dispensation of water through the water outlet 191 begins (520). The dispensing of water continues for a predetermined time. The predetermined time may be a preset time that the user may set to control the amount of water dispensed when the button tray 210 reaches the first position X1. A predetermined amount of water also may be set and dispensed. In this position, the user may receive the dispensed water after stopping the movement of the container, and thereby stopping the movement of the button tray 210. The user may further move the container in the direction X from the first position X1 where the dispensation of water begins.

Dispensing also may not begin until the button tray 210 has been maintained at the first position X1 for a predetermined time (e.g., one second). Waiting until the button tray 210 has been maintained at the first position X1 for the predetermined time prior to dispensing may avoid inadvertent dispensing of water (e.g., the user may not wish to dispense content or may wish to dispense ice without dispensing water).

A button or other control may be used to control the type of content dispensed. For example, a user may select to dispense ice using a button or other control. In this example, when the button tray 210 reaches the first position X1, water is not dispensed because the user has selected to dispense ice. Enabling a user to select a type of content may avoid inadvertent dispensing of undesired content. The button or other control may enable the user to select water only, ice only, or both ice and water.

When the user subsequently further pushes the container in the direction X such that the button tray 210 reaches the third position X3, the informing unit 290 operates to inform the user that water is no longer being dispensed and that further movement of the button tray 210 controls dispensing of ice (530). For example, the informing unit 290 outputs desired information to the user in accordance with a signal from the controller, using a sound or light. Accordingly, the user recognizes the fact that water dispensing has been completed and/or the fact that ice will be dispensed upon further movement of the button tray in the direction X.

When the user subsequently further pushes the container in the direction X such that the button tray 210 reaches the second position X2, ice is dispensed through the ice outlet 121 (540). Similar to the dispensing of water, the dispensing of ice may be carried out for a predetermined time previously set in the controller. In other implementations, dispensing of ice may be carried out for a predetermined amount, may be carried out while the button tray 210 is maintained in the second position X2, etc.

As discussed above, dispensing may not begin until the button tray 210 has been maintained at the second position X2 for a predetermined time (e.g., one second). A button or other control also may be used to control the type of content dispensed.

When the user releases the force pushing the container, after the predetermined time has elapsed, namely, when the user moves the container in an outward direction of the door, the button tray 210 moves along with the container toward the water outlet 191 and ice outlet 121 (550).

That is, the button tray 210 moves to an original position thereof, to receive a residual content left in the moving chute or water discharge duct.

When the container and the button tray 210 move in a close contact state, namely, when the movement speed of the button tray 210 is equal to the movement speed of the container, ice or water may be prevented from being dropped outside the container.

FIG. 6 illustrates a front surface of a door including a dispenser. The food storing apparatus shown in FIG. 6 includes a dispenser having an outlet 1200 to discharge content, a door 60, at which the dispenser is installed, and a button tray composite device 2000 to control the dispensation of the content, and to receive a residual content discharged out of the outlet 1200 after content has been dispensed.

A button tray 2100 and a tray drive mechanism, which are included in the button tray composite device 2000, are similar to the button tray and tray drive mechanism described above. Accordingly, further description of the button tray 2100 and tray drive mechanism has not been provided. In FIG. 6, the button tray is designated by reference numeral 2100.

The door 60 includes at least a portion extending into the inner space of the door, to form a recess or dispensing cavity S. The outlet 1200 is arranged in the recess or dispensing cavity S. The button tray 2100 is arranged below the outlet 1200.

In detail, the button tray 2100 is positioned beneath the outlet 1200 when no content is dispensed. When the user pushes the button tray 2100 toward the inner space of the door 60, the button tray 2100 is partially inserted into the inner space of the door 60. At this time, a button switch, which is mounted to one side of the button tray 2100, contacts or is connected to a dispensing switch installed in the inner space of the door 60, thereby generating a signal enabling the dispensation of content.

When the user subsequently releases the force pushing the button tray 2100, namely, when the user releases a container, which is used to receive the content, from the button tray 2100, the button tray 2100 moves to an original position thereof (e.g., a position beneath the outlet 1200).

In some examples, the button tray 2100 may be arranged in the interior of the door 60, even after the use thereof is completed. For example, the button tray 2100 may be configured such that, only when it is desired to use the button tray 2100, the button tray 2100 is ejected from the interior of the door 60, for the use thereof.

Where the button tray is configured such that, after the content dispensation, the button tray is again inserted into the interior of the door, a separate blocking device may be provided, in order to prevent the discharge of water or ice.

FIG. 7 is a perspective view of a part of a food storing apparatus, illustrating a front surface of a door. The food storing apparatus shown in FIG. 7 includes a dispenser having outlets 1210 and 1230 to discharge certain contents, a door 60, at which the dispenser is installed, and a button tray composite device 3000 to control the dispensation of a desired content, and to receive a residual content discharged out of the outlet 1210 or 1230 after the content dispensation.

The button tray composite device 3000 (including the button tray 3100) is similar to the button tray composite devices (and components) described above. Accordingly, further description of the button tray composite device 3000 has not been provided.

The outlets 1210 and 1230, which discharge contents (e.g., ice and water, respectively), are positioned on or outside of the front surface of the door 60. In particular, the outlet 1230, which is a water outlet, is positioned further from the front surface of the door 60, than the outlet 1210, which is an ice outlet. In accordance with this arrangement, a convenience in use may be provided to a user that more frequently desires the dispensation of water, than the dispensation of ice.

The button tray 3100 is positioned at or outside of the front surface of the door 60 such that it is arranged beneath the outlets 1210 and 1230.

The food storing apparatus also may include a protective cover 1000 mounted to the front surface of the door 60, to protect the outlets 1210 and 1230. A control panel 1100 may be installed at the protective cover 1000, to control the dispensation of a content.

A lower tray 1250 also may be arranged beneath the button tray 3100, as an auxiliary tray to receive a residual content discharged out of the outlets 1210 and 1230 after the content dispensation. The lower tray 1250 may be mounted to a front frame of the door 60 by hooks 1251 such that the lower tray 1250 is removable and replaceable.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

As apparent from the above description, a dispenser may allow a user to conveniently receive ice and water dispensed by the dispenser, irrespective of the size and kind of a container, which is used to receive the dispensed ice and water, because a portion of the dispenser is positioned outside of the front surface of the door.

The food storing apparatus described above may provide the following effects. A single button tray may function as a switch for two or more kinds of contents by controlling dispensing of content such that different contents are dispensed in accordance with different moved positions of the button tray, respectively.

A user may recognize whether or not a content is dispensed, based on movement of the button tray, in accordance with an informing unit installed at one side of the food storing apparatus. A residual content that is additionally discharged after the dispensation of a certain content may be prevented from being dropped onto the floor, in accordance with the provision of the button tray composite device, which not only functions as a button enabling dispensing of content, but also functions as a tray receiving residual content.

In particular, a tray drive mechanism, which is included in the button tray composite device, may move the button tray toward a dispenser outlet, from which the residual content is discharged, after dispensing of content, in order to allow the button tray to receive the residual content. The button tray composite device may be used in any case, irrespective of the position of an outlet, from which the content is discharged. For example, the button tray composite device may be used in the case in which the outlet is tilted out of the interior of the door, the case in which the outlet is attached to a front surface of the door, and the case in which the outlet is arranged in a recess or dispensing cavity formed at the door.

The residual content may be received in a state in which the moving chute is positioned outside of a front surface of the door, but also in a state in which the moving chute is inserted into the interior of the door.

What is claimed is:

1. An appliance comprising:

a compartment;

a door configured to open and close at least a portion of the compartment;

a dispenser that is positioned on a surface of the door and having at least one dispenser outlet, the dispenser being configured to dispense at least first and second types of content;

a button tray configured to move, at least partially toward and away from the surface of the door, in response to application of force against the button tray; and a controller configured to respond to repositioning of the button tray by controlling a type of content dispensed by the dispenser based on a position of the button tray that results from movement of the button tray, the controller being configured to control the dispenser to dispense the first type of content in response to the button tray being moved to a first position and being configured to control the dispenser to dispense the second type of content in response to the button tray being moved to a second position; the second position is different from the first position.

2. The appliance according to claim 1, wherein:

the button tray is configured to move along a path divided into multiple stages, the multiple stages including a water dispensing stage in which the button tray is positioned in the water dispensing stage and the controller respectively controls the dispenser to dispense water, and an ice dispensing stage in which the button tray is positioned in the ice dispensing stage and the controller respectively controls the dispenser to dispense ice.

3. The appliance according to claim 2, wherein the button tray passes through the water dispensing stage to reach the ice dispensing stage, and the controller is configured to reduce undesired dispensing of water while the button tray is being moved through the water dispensing stage to the ice dispensing stage.

4. The appliance according to claim 3 wherein the controller is configured to reduce undesired dispensing of water while the button tray is being moved through the water dispensing stage to the ice dispensing stage by waiting until a position of the button tray has been maintained in the water dispensing stage for a predetermined amount of time prior to controlling the dispenser to dispense water.

5. The appliance according to claim 3 further comprising:

an input control configured to enable a user to select a type of content to dispense, the input control being configured to enable the user to select at least one of water and ice, wherein the controller is configured to reduce undesired dispensing of water while the button tray is being moved through the water dispensing stage to the ice dispensing stage by, when the user has selected to dispense ice, preventing the dispenser from dispensing water when the button tray is positioned in the water dispensing stage.

6. The appliance according to claim 1, further comprising:

a tray movement control mechanism configured to move the button tray away from the surface of the door in the absence of force applied to the button tray in a direction that is toward the surface of the door, and to change a position of the button tray from a misaligned position in which the button tray is misaligned with the at least one dispenser outlet to a receiving position in which the button tray is aligned with and captures content dispensed through the at least one dispenser outlet, where the tray movement control mechanism allows the button tray to move into the misaligned position in response to force that is applied to the button tray and where the control mechanism causes the button tray to move into the receiving position in response to removal of force that is applied to promote positioning of the button tray in the misaligned position.

7. The appliance according to claim 6 wherein the tray movement control mechanism is configured to move the button tray away from the surface of the door by rotating the button tray away from the surface of the door about a pivot point.

8. The appliance according to claim 1, wherein the first position is further from the surface of the door than the second position, and the controller is configured to control the dispenser to dispense water in response to the button tray being moved to the first position and is configured to control the dispenser to dispense ice in response to the button tray being moved to the second position.

9. The appliance according to claim 1 wherein:

the at least one dispenser outlet includes a water outlet and an ice outlet, the controller is configured to control the dispenser to dispense water in response to the button tray being moved to the first position and is configured to control the dispenser to dispense ice in response to the button tray being moved to the second position, and a container is positioned to receive content dispensed through the water outlet when the button tray is moved to the first position using the container; and the container is positioned to receive content dispensed through the ice outlet when the button tray is moved to the second position using the container.

10. The appliance according to claim 1, further comprising:

a first distance sensor mounted to the button tray and a second distance sensor arranged at a predetermined position in a space defined by a frame of the door, the first and second distance sensors being configured to detect a position of the button tray.

11. The appliance according to claim 1, further comprising:

an informing unit configured to generate an output that indicates a type of content being dispensed based on a position of the button tray that results from movement of the button tray.

12. The appliance according to claim 11, wherein the informing unit is configured to generate a sound or light that indicates the type of content being dispensed based on the position of the button tray.

13. The appliance according to claim 11, wherein:

the button tray is configured to move along a path divided into multiple stages, the multiple stages including a water dispensing stage in which the controller controls the dispenser to dispense water when the button tray is positioned in the water dispensing stage, an ice dispensing stage in which the controller controls the dispenser to dispense ice when the button tray is positioned in the ice dispensing stage, and a transition stage defined between the water dispensing stage and the ice dispensing stage; and the informing unit is configured to generate a transition output when the button tray is positioned in the transition stage, the transition output indicating movement of the button tray from the water dispensing stage to the ice dispensing stage.

14. The appliance according to claim 1, wherein:

the at least one dispenser outlet comprises a water outlet configured to dispense water and an ice outlet configured to dispense ice; and the water outlet is arranged further from the compartment than the ice outlet.

15. The appliance according to claim 1, further comprising:

a moving chute that is configured to move between an operable position in which the moving chute is at least partially positioned on a side of the surface of the door opposite of the compartment, and a stored position in which the moving chute is positioned entirely on a side the surface of the door where the compartment is positioned, where the moving chute has structure that defines at least a portion of a passage through which content is discharged from the dispenser.

16. The appliance according to claim 1, wherein:

the door has at least a portion extending into a dispensing cavity that houses the dispenser positioned on the surface of the door; and the at least one dispenser outlet of the dispenser is arranged in the dispensing cavity.

17. The appliance according to claim 1, wherein the at least one dispenser outlet is positioned outside of a surface of the door that is furthest from the compartment.

18. The appliance according to claim 13, further comprising:

a lower tray that is attached to the surface of the door that is furthest from the compartment and, when the appliance is oriented in a normal operating orientation, is positioned beneath the at least one dispenser outlet, the lower tray being configured to receive content dispensed out of the at least one dispenser outlet when the appliance is oriented in the normal operating orientation.

19. A method for controlling an appliance, comprising:

enabling movement of a button tray at least partially toward and away from a compartment of the appliance in 'response to application of force against the button tray;

controlling a dispenser, which has at least one dispenser outlet and which is configured to dispense at least first and second types of content, to dispense the first type of content in response to the button tray being moved to a first position; and controlling the dispenser to dispense the second type of content in response to the button tray being moved to a second position; the second position is different from the first position.

20. The method according to claim 19, further comprising:

generating an output that indicates a type of content being dispensed based on a position of the button tray that results from movement of the button tray.

21. The method according to claim 19, further comprising:

moving, in response to release of a force that caused the button tray to move to at least one of the first and second positions, the button tray toward an original position in which the button tray is positioned to receive content dispensed by the dispenser to enable the button tray to receive a residual content dispensed by the dispenser.

22. The method according to claim 21, further comprising:

coordinating movement, together with the button tray, of a moving chute that defines a content discharge passage and that is positioned above the button tray when the appliance is oriented in a normal operating position.

23. The method according to claim 19, wherein the button tray moves through the first position to reach the second position, further comprising reducing undesired dispensing of the first type of content while the button tray is being moved through the first position to the second position.

24. The method according to claim 23 wherein reducing undesired dispensing of the first type of content while the button tray is being moved through the first position to the second position comprises waiting until a position of the button tray has been maintained in the first position for a predetermined amount of time prior to controlling the dispenser to dispense the first type of content.

25. An appliance comprising:

a compartment;

a door configured to open and close at least a portion of the compartment;

a dispenser that is positioned on a surface of the door and having at least one dispenser outlet, the dispenser being configured to dispense at least first and second types of content;

means for enabling movement of a button tray at least partially toward and away from the compartment of the appliance in response to application of force against the button tray; means for controlling the dispenser to dispense the first type of content in response to the button tray being moved to a first position; and means for controlling the dispenser to dispense the second type of content in response to the button tray being moved to a second position; the second position is different from the first position.

* * * * *